United States Patent [19]

Miller

[11] Patent Number: 4,936,112

[45] Date of Patent: Jun. 26, 1990

[54] GAS COMPRESSORS

[75] Inventor: Alan S. Miller, Redbrook Lower Dinedor, England

[73] Assignee: Rotocold Limited, Hereford, England

[21] Appl. No.: 227,941

[22] Filed: Aug. 3, 1988

[30] Foreign Application Priority Data

Aug. 3, 1987 [GB] United Kingdom ..... 8718314

[51] Int. Cl.[5] ..... F25B 31/02

[52] U.S. Cl. ..... 62/505; 417/368

[58] Field of Search ..... 62/505; 417/368, 365, 417/372

[56] References Cited

U.S. PATENT DOCUMENTS

| | | | |
|---|---|---|---|
| 1,897,199 | 2/1933 | Kenney | 62/505 X |
| 1,960,576 | 5/1934 | Dennedy | 62/505 |
| 3,079,763 | 3/1963 | Schneider et al. | 62/505 X |
| 3,122,894 | 3/1964 | Bernhard | 62/505 X |
| 3,192,735 | 7/1965 | Bernhard | 62/505 X |
| 3,379,033 | 4/1968 | Grant | 62/505 |
| 4,006,602 | 2/1977 | Fanberg | 62/505 X |
| 4,049,410 | 9/1977 | Miller | 62/505 |
| 4,254,637 | 3/1981 | Branch et al. | 62/505 X |
| 4,480,967 | 11/1984 | Schulze | 417/371 X |

*Primary Examiner*—William E. Tapolcai

*Attorney, Agent, or Firm*—Nixon & Vanderhye

[57] ABSTRACT

A rotary vane gas compressor e.g. for use in refrigeration is driven by an electric motor which is cooled by a refrigerant liquid passed through a heat exchanger which is attached to the external surface of the stator of the motor. The refrigerant is then passed back into the compression chamber of the gas compressor via a port intermediate between the inlet and outlet ports.

5 Claims, 2 Drawing Sheets

GAS COMPRESSORS

Figure 1:
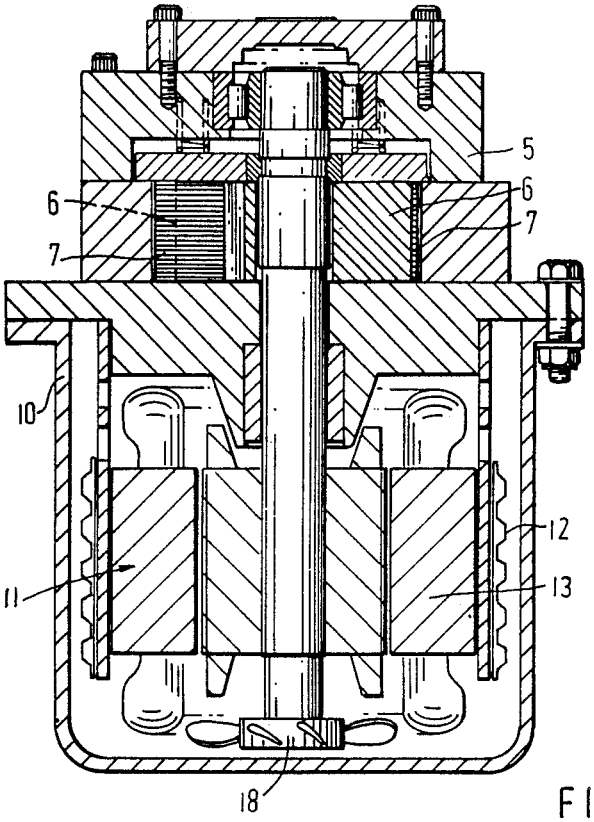

This invention relates to gas compressors and particularly to electric hermetic or semi-hermetic motor compressor units used on closed gas vaporization condensing cycles for refrigeration. It is concerned with rotary vane compressors of the multi-cell type having four or more moving vanes.

A known method of cooling the motor on a hermetic or semihermetic motor compressor unit, where the motor is encapsulated within a pressure vessel, is to allow the gas returning from the evaporator to pass over the motor body before entering the inlet of the compressor. The motor loses heat to the gas and the gas in turn becomes considerably superheated. This has two disadvantages. First, the specific volume of gas is increased and in consequence the weight of gas pumped is decreased. Second, because of the higher inlet temperature the discharge gas temperature from the compressor is correspondingly increased and this can reach the critical limit of the machine unless the operating parameters of the compressor are restricted, in which case the field of application is reduced. There has recently been concern about the impact of certain halogen containing gases on the ozone layer around the earth. The use of many of the common refrigerants is expected to be restricted in forthcoming regulations. One of the safest refrigerants currently available is known as R-22. In the known types of compressor this refrigerant has the disadvantage it cannot be used under certain conditions, e.g., very high ambient temperatures, so that a less acceptable refrigerant must be used instead.

It is known from U.S. Pat. No. 3192735 to locate a cooling coil about the hermetic motor in a refrigerant system and to pass liquid refrigerant over the motor to cool the motor and to supply the gas so formed to the low pressure side of the refrigerant system. In the system disclosed the compressor is a centrifugal compressor and the gas is supplied direct to the condenser.

U.S. Pat. No. 4049410 (Miller) discloses a rotary vane compressor of the multi-cell type which includes a means for cooling the motor without allowing direct contact between the motor and the refrigerant gas circulating within the system.

It is one object of this invention to provide a rotary vane gas compressor of the multi-cell type incorporating an electric motor, especially a variable speed electric motor, including means for cooling the motor without reducing the volumetric swept capacity of the compressor. It is a further object to provide a compressor which can be used with a refrigerant gas such as R-22 over a wide range of temperature and pressure conditions.

In accordance with one aspect of the invention there is provided a rotary compressor to be placed in circuit with a reservoir of refrigerant liquid and a condenser the compressor having a motor therefor, the compressor comprising a chamber housing a rotor, an inlet port in the wall of the chamber for gas to be drawn into the chamber and an outlet port for the discharge of the gas, the outlet port being radially spaced from the inlet port, a heat exchanger located about the motor and arranged so that refrigerant liquid passes through the heat exchanger, the rotor having at least four vanes, which in rotation between the inlet port and the outlet port define individual suction and compression chambers, wherein means are provided to supply a mixture of liquid and partially vaporised refrigerant gas to a suction chamber at a location between the inlet port and the outlet port to join gas under suction therein, and wherein the gas released from the outlet port is passed through the condenser and is returned to the reservoir.

Preferably the liquid refrigerant is allowed or caused to enter the heat exchanger under pressure at a rate controlled by an automatic metering valve.

The outlet of the heat exchanger is connected to a port in the compression chamber of the compressor located in a position between the inlet and the outlet ports such that re-entry of gas from this port to the inlet cell is avoided. On entry into the heat exchanger liquid refrigerant is arranged to experience a considerable reduction in pressure arising from a pressure drop across the metering valve. The liquid vaporises and the motor heat is extracted in the latent heat of vaporization of the refrigerant. The gas arising is drawn into the compressor at approximately mid stage of the compression cycle where is intermingles with the main circuit gas from the evaporator and is carried through the cycle.

The heat exchanger for cooling the motor can exist in a number of different forms. One preferred form is that of a plate heat exchanger secured to the external surface of the motor stator and comprising two plates resistance welded at the edges and roll spot welded or roll bonded over the face. The plates are then held tightly and hydraulically inflated to create a pillowing effect and thus form an internal flow path. Another form is a simple coil wound tightly around the motor stator and clamped thereto by one or more metal bands.

In another aspect the invention provides means for reducing the discharge gas temperature from the compressor and consequently also the temperature of oil which is circulated with the gas.

In yet another aspect the invention provides a method of reducing the temperature of an enclosed space over a wide range of ambient temperatures, the method comprising passing a refrigerant gas through a circuit including a compressor, a reservoir of refrigerant liquid and a condenser, wherein the refrigerant gas is so called R-22 gas and the gas is passed through a rotary compressor having a motor therefor, the compressor comprising a chamber housing a rotor, an inlet port in the wall of the chamber for gas to be drawn into the chamber and an outlet port for the discharge of gas, the outlet port being radially spaced from the inlet port, a heat exchanger located about the motor and arranged so that refrigerant liquid passes through the heat exchanger, the rotor having at least four vanes which in rotation between the inlet port and the outlet port define individual suction and compression chambers, wherein means are provided to supply a mixture of liquid and partially vaporized refrigerant gas to a suction chamber at a location between the inlet port and the outlet port to join gas under suction therein, and wherein the gas released from the outlet port is passed through the condenser and is returned to the reservoir.

It is an advantage of the compressor that due to the lower gas temperature reached, the refrigerant R-22 may be used over a much wider range of conditions.

Figure 2:
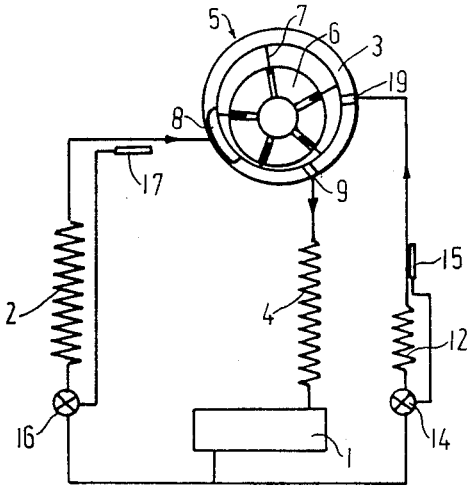
Figure 3:
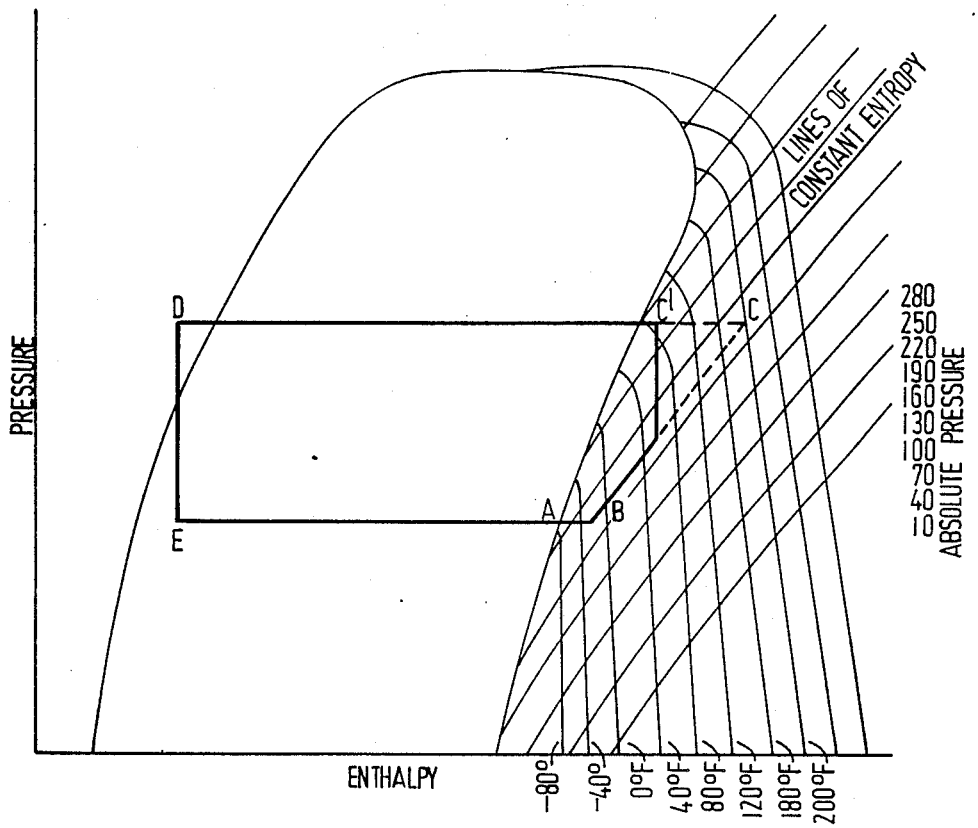

In order that the invention may well be understood it will now be described by way of example with reference to the accompanying diagramatic drawings in which;

FIG. 1 is a part sectional schematic view of one apparatus of the invention; FIG. 2 is a circuit diagram; and FIG. 3 is a pressure enthalpy diagram.

Referring first to FIGS. 1 and 2 the apparatus includes a liquid reservoir 1 which is in circuit with an evaporator 2, compressor 3 and a condenser 4.

The compressor 3 comprises a housing 5 in which there is a rotor 6 having four or more radially spaced apart vanes 7 which move in slots therefor. The compressor draws gas from the evaporator 2 via the gas inlet port 8 and discharges it via a discharge outlet 9 to the condenser 4 from which it is then passed on to the receiver 1. As a rotor rotates the vanes 7 define chambers or cells to receive gas, and the gas is successively subjected to successive stages of suction and then compression as is moves from inlet port 8 to outlet port 9.

The housing 5 is mounted on top of a pressure vessel 10 housing the electric motor 11 which drives the rotor 6. A plate heat exchanger 12 is welded to the external surface of the motor stator 13. The exchanger is formed of plates welded together, and the refrigerant is arranged to circulate in a counterflow arrangement within the exchanger 12. An expansion valve 14 controls the inflow of refrigerant and an expansion valve phial 15 is present at the outflow side. An evaporator expansion valve 16 is present at the inlet side of the evaporator 2, and an expansion valve phial 17 controls the valve 16. A fan 18 is present at the distal end of the motor 11 to move gas present in the vessel 10 over the heat exchanger 12. A port 19 is present midway between the inlet port 8 and the discharge outlet 9.

In use, the compressor draws gas from the evaporator 2. The gas is compressed by the rotor 6 in a compression expansion cycle in the cells defined in the housing 5 by the vanes 7 and is discharged via the outlet 9 to the condensor 4 and then returned to the receiver 1. In addition, refrigerant liquid is drawn from the receiver 1 via the valve 14 into the pressure vessel 10 to the heat exchanger 12 to cool the motor 11. The liquid is partially evaporated by passage over the hot motor and the resultant liquid/gas mixture is drawn into the housing at the port 19 to join gas in a suction chamber so that the gas under primary suction and the liquid/gas mixture together undergo compression. In this way the motor is cooled satisfactorily without derating of the efficiency of the compressor.

The thermodynamic process is best understood by reference to the pressure-enthalpy diagram of FIG. 3. E-A is the evaporation at constant temperature process. A-B is the gas superheat before compression. B-C gas compression. C-D is desuperheating, condensation and liquid sub cooling. D-E is pressure reduction at constant entropy. The effect of introducing the motor cooling circuit according to the invention is to impart a degree of desuperheating of the gas during the actual compression process and the resulting thermodynamic effect of this is shown by the compression line B-C1 which clearly shows that lower gas temperatures are reached, compared to those from a known compressor shown on the dotted line B-C.

The benefits of this invention compared with known systems of motor cooling for hermetic and semi-hermetic compressors are that there is no reduction in the pumping capacity of the compressor; the considerable reduction in discharge gas and oil temperature provides a wide field of application and a wide band of operating parameters; and the hermetic or semi-hermetic motor compressor can be operated over a wide range of speeds, achieved by electronic speed control, with the motor cooling being essentially independent of speed.

The invention is not limited to the embodiment shown. The pressure vessel may include the compressor as well as the motor. The apparatus may be mounted horizontally, and the compressor may have any shape of multivaned rotor.

What is claimed is:

1. A rotary compressor in circuit with a reservoir of refrigerant liquid, said refrigerant liquid being R-22, an evaporator and a condensor therefor, the compressor comprising a chamber, a rotor eccentrically mounted within the chamber, an inlet port in the wall of the chamber for gas to be drawn into the chamber, an outlet port for the discharge of gas, the outlet port being circumferentially spaced from the inlet port, and a further port located between the inlet and outlet ports, the rotor having at least four vanes which, in rotation between the inlet and outlet ports, define individual suction and compression chambers, a pressure vessel housing a heat generating motor therefor, a heat exchanger in the vessel disposed about the motor and having an inlet end and an outlet end, said exchanger comprising two plates welded together at the edges and bonded over their face and hydraulically inflated to form an internal flow path, the motor including a stator and the heat exchanger being secured to the outer surface of the stator, the compressor being located at one end of the vessel, the rotor being effective to draw refrigerant gas from the evaporator into the inlet port and to discharge compressed refrigerant gas to the outlet port for flow to the condensor and the reservoir, means for drawing refrigerant liquid from the reservoir through the heat exchanger and then to pass that liquid to the further port thereby to cool the motor, the latent heat vaporization of the liquid entering the compressor through said further port cooling the gas in the compressor, a fan at one end of the motor to cause gas within the pressure vessel to flow over the heat exchanger, an expansion valve at the inlet end of the heat exchanger for controlling the rate of supply of the refrigerant liquid to the heat exchanger, an expansion valve phial connected to the expansion valve adjacent the outlet end of the heat exchanger to control the expansion valve so that the liquid entering the heat exchanger is controlled in proportion to the temperature of the liquid leaving the heat exchanger and independently of motor speed, whereby in use the motor may be effectively cooled without reducing the volumetric swept capacity of the compressor.

2. A compressor according to claim 1 wherein the exchanger comprises a coil wound about the stator.

3. A compressor according to claim 1 wherein the compressor is of the hermetic or semi-hermetic type.

4. A compressor according to claim 1 wherein the motor includes variable speed controls.

5. A compressor according to claim 1, wherein oil is circulated with the refrigerant gas.

* * * * *